United States Patent [19]

Tomioka et al.

[11] 4,088,000

[45] May 9, 1978

[54] HOT FORGING MACHINE HAVING DIE PREHEATING UNIT

[75] Inventors: Kunio Tomioka; Masaaki Kita; Terushige Sakurai, all of Komatsu, Japan

[73] Assignee: Kabushiki Kaisha Komatsu Seisakusho, Tokyo, Japan

[21] Appl. No.: 792,975

[22] Filed: May 2, 1977

[51] Int. Cl.[2] ..... B21J 9/00

[52] U.S. Cl. ..... 72/342; 72/446

[58] Field of Search ..... 72/342, 448, 446; 100/92, DIG. 18

[56] References Cited

U.S. PATENT DOCUMENTS

| | | | |
|---|---|---|---|
| 2,543,498 | 2/1951 | Japikse | 100/DIG. 18 |
| 3,002,479 | 10/1961 | Johansen et al. | 100/DIG. 18 |
| 3,427,855 | 2/1969 | Michelson | 72/448 |
| 3,698,219 | 10/1972 | Moore et al. | 72/342 |
| 3,841,141 | 10/1974 | Rachwal | 72/446 |

*Primary Examiner*—Lowell A. Larson

*Attorney, Agent, or Firm*—Armstrong, Nikaido, Marmelstein & Kubovcik

[57] ABSTRACT

A hot forging machine having die preheating unit thereby allowing the die to be heated at a required temperature while the forging machine is in operation. The apparatus comprises a forging machine having a moving bolster, a pair of main rails extending from said forging machine, two pairs of first and second branch rails provided perpendicular to said main rails, a heating unit for the die provided at one end of said first branch rails, and a pattern change unit for changing and/or repairing the die provided at one end of said second branch rails, the moving bolster of said forging machine being adapted to run on said respective rails.

3 Claims, 5 Drawing Figures

HOT FORGING MACHINE HAVING DIE PREHEATING UNIT

BACKGROUND OF THE INVENTION

This invention relates to a hot forging machine having a die preheating unit fitted outsides of the machine body thereof.

The conventional forging machines for forging heated blanks or work pieces are disadvantageous in that, when there is a remarkable temperature difference between the work peices to be forged and dies, the dies attahced to slides and bolsters are preheated directly by means of gas burners in the forging machine for the purpose of preventing deformation and damage of the dies due to thermal expansion thereof, and the preheating time is about half an hour, although it depends on the size of dies, and during the preheating the hot forging operation is required to be interrupted thereby reducing the operation efficiency so much.

SUMMARY OF THE INVENTION

It is therefore an object of the present invention to provide a hot forging machine wherein a heating unit for a die is provided outside the forging machine.

Another object of the present invention is to provide a hot forging machine wherein a die is preheated outside the forging machine while the forging machine is in operation thereby improving the operational efficiency of the forging machine so much. According to the present invention, there is provided a hot forging machine comprising a forging machine having a moving bolster, a pair of main rails extending from said forging machine, a pair of first branch rails provided perpendicular to said main rails, a pair of second branch rails provided perpendicular to said main rails and a spaced relationship with said first branch rails, a heating unit for a die provided at one end of said first branch rails, and a pattern change unit for changing and/or repairing the die provided at one end of said second branch rails, the moving bolster of said forging machine being adapted to run on said respective rails whereby preheating of the die by said heating unit can be effected while said forging machine is in operation.

Other objects, features and advantages of the present invention will be readily apparent from the following description taken in conjunction with the accompanying drawings.

DETAILED DESCRIPTION OF THE PREFERRED EMBODIMENT

Figure 1:
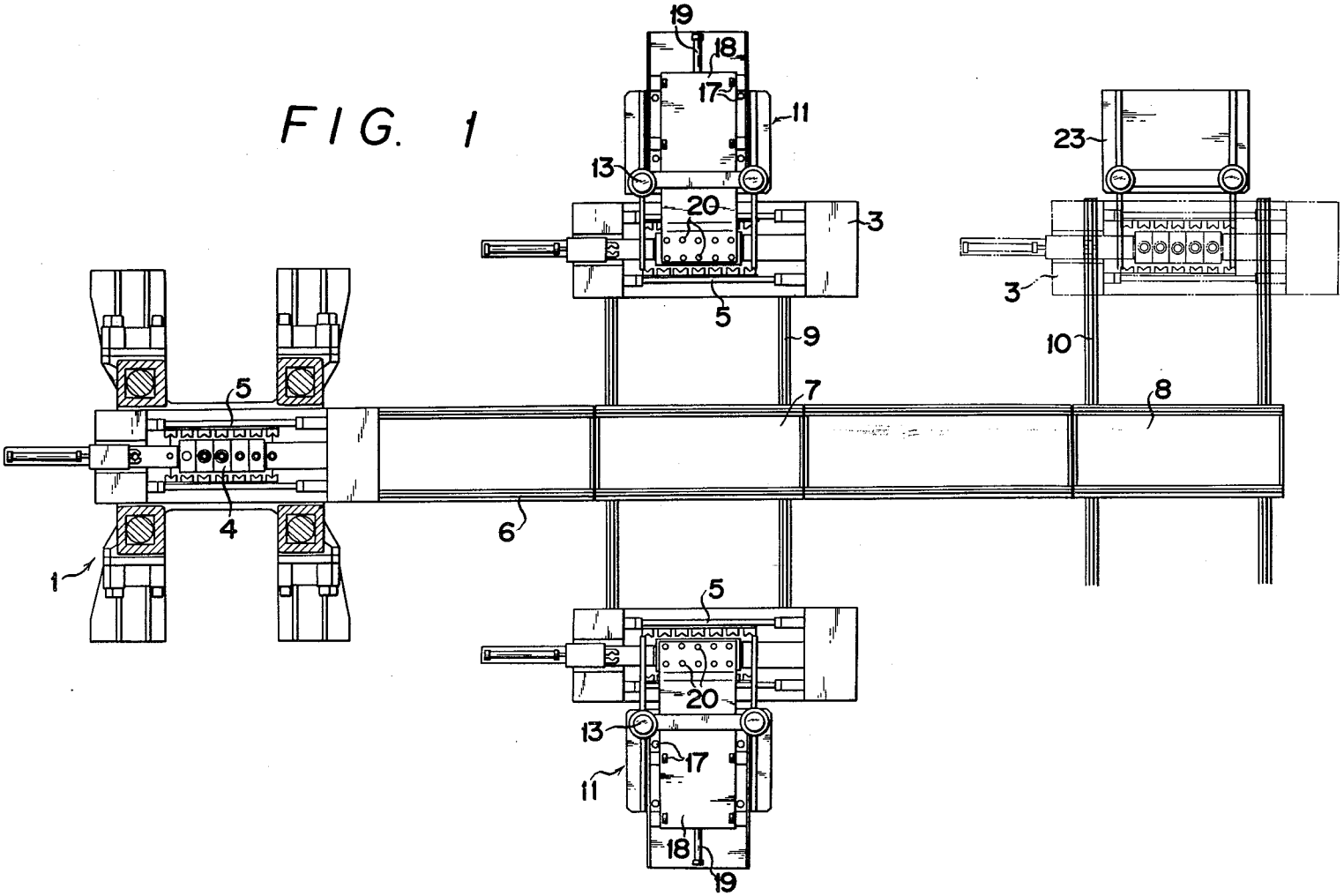
FIG. 1 is a plan view of the overall hot forging machine according to the present invention.
Figure 2:
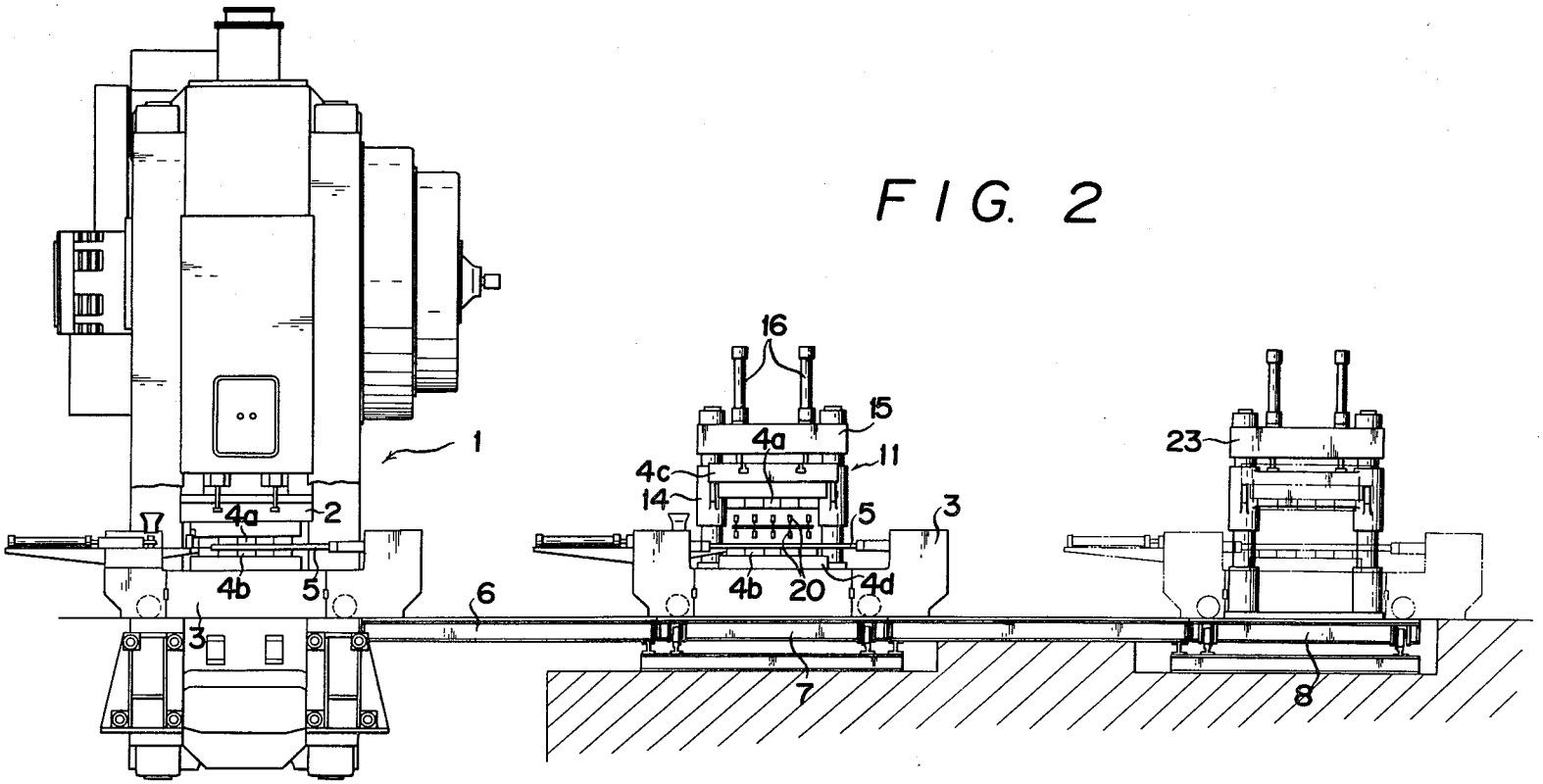
FIG. 2 is a side view of FIG. 1.
Figure 3:
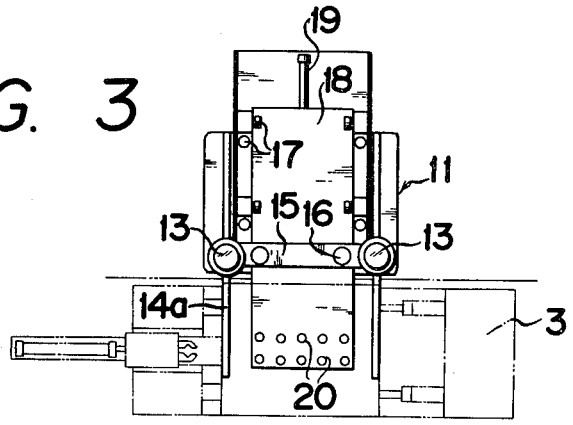
FIG. 3 is a plan view of the heating unit according to the present invention.
Figure 4:
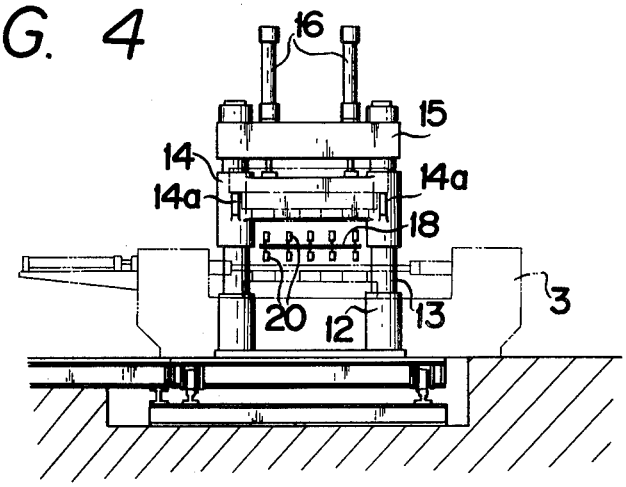
FIG. 4 is a front elevational view of FIG. 3.
Figure 5:
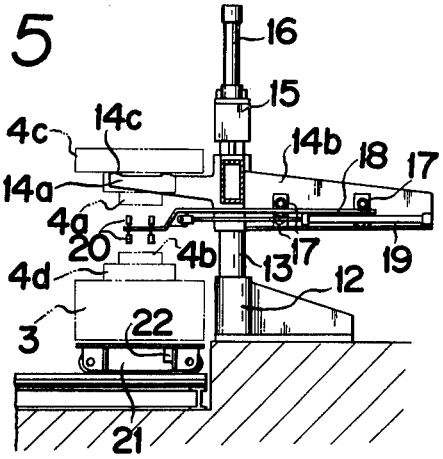
FIG. 5 is a side view of FIG. 3.

The present invention will now be described in detail below by way of an example with reference to the accompanying drawings. In the drawings, reference numeral 1 denotes a hot forging machine body. A plurality of dies are attached to a slide 2 and a moving bolster 3 for successive work steps. Installed on both sides of the dies 4 which are attached through a die holder **4*d* to the upper surface of the moving bolster 3 are feed mechanisms 5 for transferring works to be forged (not shown) for the next successive work steps. A pair of main rails 6 extend from the machine body 1 in the direction of pulling out the bolster 3. As can be seen from FIG. 1, the intermediate portions and the portions of the main rails 6 opposite to the machine body 1 are separated from the portions thereof and are fixedly secured to trucks 7 and 8, respectively. The trucks 7 and 8 are slidably mounted on two pairs of branch rails 9 and 10 extending at right angles to the main rails 6, respectively. Mounted on both end portions of the first branch rails 9 are two sets of preheating units 11. As best shown in FIGS. 3, 4 and 5, the preheating unit 11 comprises a pair of spaced-apart vertically extending guide rods 13 fitted to a base 12. A lift frame 14 is slidably carried by the guide rods 13. The above-mentioned lift frame 14 comprises a pair of upwardly extending lift arms 14*a* and a support rod 14*b* extending from the side opposite to the lift arms 14*a*. A cross bar 15 is fixedly secured to the upper ends of the guide rods 13. The lift frame 14 can be moved up and down along the guide rods 13 by the action of hydraulic lift cylinders 16 fixedly secured to the cross bar 15. Each of the upper surfaces of the lift arms 14*a* has formed therein a portion 14*c* for carrying the die holder 4*c* to which is attached the die 4 to be preheated. Further, guide rollers 17 are mounted on the opposite faces of the support rod 14*b* of the lift frame 14. A horizontally movable base 18 is supported by the guide rollers 17. Installed below the horizontally movable base 18 is a hydraulic cylinder 19 for reciprocating the horizontally movable base 18 in the transverse direction. Gas burners 20 are attached to the leading end of the horizontally movable base 18 for the purpose of heating at the same time an upper die 4*a* raised by the lift arms 14*a* and a lower die 4*b* set on the moving bolster 3. Reference numeral 21 denotes a moving carrier for the moving bolster 3 which is adapted to run on the main and the first branch rails 6 and 9 by means of a driving power source 22. Mounted on the second branch rails 10, which are connected to the leading end portion of the main rails 6 and extend at right angles thereto, is a pattern change unit 23 for replacing dies and for adjusting and cleaning the parts. The pattern change unit 23 serves to replace used dies 4, adjust the feed mechanisms 5** and replace attachments.

Thus, dies 4 which have been preheated by the preheating unit 11 are located in the forging machine body 1 and subjected to forging operation, while dies 4 to be used next are heated by the preheating unit 11 installed outside the machine body 1 in such a manner as will be mentioned below.

The dies 4 which have been prepared in good condition and the feed mechanisms 5 are moved from the branch rails 10 to the main rails 6, and then conveyed to the preheating unit 11 through the main and branch rails 6 and 9. In the preheating unit 11, the upper dies **4*a* out of the dies 4 which have been conveyed therein are raised by the lift arms 14*a* to a predetermined position, the horizontally movable base 18 is moved forwards, and the gas burners 20 are positioned between the upper and lower dies 4*a* and 4*b* so as to heat them at the same time. When used dies 4 have been drawn out, dies 4 which have been preheated are drawn into the forging machine body 1 so as to effect the next forging operation. Further, another set of dies 4 are conveyed from the pattern change unit 23 into the preheating unit 11** where preheating of them is effected.

In the above-mentioned embodiment of the present invention, two sets of preheating units 11 are installed on both sides of the main rails 6 for bringing the bolster 3 in and out; however, one or more than two sets of preheating units may be installed as and when required.

It is to be understood that the foregoing description is merely illustrative of the preferred embodiment of the present invention and that the scope of the present invention is not to be limited thereto, but is to be determined by the scope of the appended claims.

We claim:

1. A hot forging machine comprising a forging machine having a moving bolster, a pair of main rails extending from said forging machine, a pair of first branch rails provided perpendicular to said main rails, a pair of second branch rails provided perpendicular to said main rails and a spaced relationship with said first branch rails, a heating unit for a die provided at one end of said first branch rails, and a pattern change unit for changing and/or repairing the die provided at one end of said second branch rails, the moving bolster of said forging machine being adapted to run on said respective rails whereby preheating of the die by said heating unit can be effected while said forging machine is in operation.

2. A hot forging machine of claim 1 wherein said heating unit comprises a base, a pair of guide rods mounted in a spaced relationship on said base, a frame slidably mounted on said guide rods, a pair of lift arms extending from said frame for lifting an upper die from the moving bolster, a cross bar mounted on said guide rods, cylinder means provided on said cross bar for lifting and lowering said frame, a movable base slidably mounted on said frame, and gas burner means provided on said movable base at one end thereof for heating the upper die supported by said lift arms and a lower die provided on the moving bolster.

3. A hot forging machine of claim 2 wherein said gas burner means being adapted to locate between the upper die and the lower die when said movable base is extended horizontally.

* * * * *